US006808372B2

(12) United States Patent
Makino et al.

(10) Patent No.: US 6,808,372 B2
(45) Date of Patent: Oct. 26, 2004

(54) COMPRESSOR WITH BUILT-IN MOTOR, AND MOBILE STRUCTURE USING THE SAME

(75) Inventors: Masahiko Makino, Shiga (JP); Yoshifumi Abe, Ritto (JP); Tsutomu Sakurabayashi, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 45 days.

(21) Appl. No.: 10/163,535

(22) Filed: Jun. 7, 2002

(65) Prior Publication Data

US 2003/0002998 A1 Jan. 2, 2003

(30) Foreign Application Priority Data

Jun. 8, 2001 (JP) ..... 2001-174430

(51) Int. Cl.[7] ..... H02K 5/00; F04B 35/04

(52) U.S. Cl. ..... 417/410.5; 417/410.1; 310/89.71

(58) Field of Search ..... 417/374, 410.1, 417/410.5, 411, 423.14, 423.15; 62/236; 310/89.71

(56) References Cited

U.S. PATENT DOCUMENTS

| | | | | | |
|---|---|---|---|---|---|
| 3,634,873 | A | * | 1/1972 | Nishimura | 318/254 |
| 4,293,281 | A | * | 10/1981 | Lamoreaux | 417/9 |
| 4,834,624 | A | * | 5/1989 | Jensen et al. | 417/370 |
| 4,963,778 | A | * | 10/1990 | Jensen et al. | 310/68 D |
| 5,904,471 | A | * | 5/1999 | Woollenweber et al. | 417/371 |
| 5,939,807 | A | * | 8/1999 | Patyk et al. | 310/89 |
| 6,178,760 | B1 | * | 1/2001 | Tanaka et al. | 62/154 |
| 6,524,082 | B2 | * | 2/2003 | Morita et al. | 417/366 |
| 6,544,009 | B2 | * | 4/2003 | Makino et al. | 417/312 |

* cited by examiner

*Primary Examiner*—Charles G. Freay
(74) *Attorney, Agent, or Firm*—Greenblum & Bernstein, P.L.C.

(57) ABSTRACT

In a compressor, an inverter control device that performs an inverter control on an electric motor is integrally provided on a body portion of a container which houses a compression mechanism and the electric motor which are axially arranged in a line. The inverter control device is connected to the electric motor to shorten the distance of wiring from the inverter device to the motor to allow the reduction in weight, the reduction in a space to be required for the installation, and the reduction in the amount of noise.

20 Claims, 3 Drawing Sheets

COMPRESSOR WITH BUILT-IN MOTOR, AND MOBILE STRUCTURE USING THE SAME

The present disclosure relates to subject matter contained in priority Japanese Patent Application No. 2001-174430, filed on Jun. 8, 2001, the contents of which is herein expressly incorporated by reference in its entirety.

BACKGROUND OF THE INVENTION

1. Field of the Invention

The present invention relates to a compressor with a built-in electric motor which is suitable to be mounted on a mobile structure such as a motor vehicle. The invention also relates to a mobile structure having such a compressor.

2. Description of Related Art

In a vehicle driven only by an engine, a compressor driven by the engine has been used for air-conditioning the vehicle compartment with the compressor being mounted alongside of the engine.

Hybrid vehicles having both an engine and an electric motor and traveling by use of one of them according to conditions have been practically used for going on public roads. Air-conditioning of the vehicle compartment of this hybrid vehicle is made by a refrigerating compressor driven by the engine in the same manner as conventional engine-driven vehicles, which is mounted alongside of the engine.

It is proposed that the engines of hybrid vehicles should be shut off while they are temporarily stationary at a place such as a traffic light in order to reduce effects of the engine upon the environment. When the proposal is followed with a vehicle where a compressor driven by the engine is used, air-conditioning stops each time when the vehicle stops, causing problem for the driver and passengers in the compartment in summer and winter seasons, and especially in regions with extremely cold or hot climate.

For solving such a problem, there is an idea of adopting a compressor 153 to be driven by an electric motor, especially a compressor to be used for air-conditioning in a building as shown in FIG. 2. The compressor with a built-in electric motor is housed in a container 152 made of iron, together with a compression mechanism 150 and an electric motor 151. In the hybrid vehicle, furthermore, the arrangement of devices in an engine room is based on that of the conventional motor vehicle. Thus, there is no space or location for installing the conventional compressor with the built-in electric motor for air-conditioning in the building in the engine room.

What is worse, the conventional compressor with the built-in electric motor has large axial dimensions. That is, a discharge port 154, a suction port 155, inner and outer electric connection parts 156, and a mounting leg portion 157 are longitudinally extended from both ends of the container 152. Such a complicated construction of the compressor is hardly incorporated in an electric-powered vehicle which has been only realized in a small-sized vehicle.

Simultaneously, the conventional compressor with the built-in electric motor is made of iron, so that the total weight thereof is about 9 kg or more. Thus, it becomes a problem in realizing the high speed and the energy saving because of the increase in driving load when it is mounted on the mobile structure.

It becomes urgent business to provide a small-sized and lightweight compressor with a built-in electric motor now in a tendency of planning an electric operation of various kinds of load by using a working voltage of 42 volts in a gasoline-powered vehicle, a hybrid vehicle, or an electric-powered vehicle. For this reason, it is considered to use a compressor 159 with a built-in electric motor having a container 158 made of aluminum as shown in FIG. 3.

An electric motor 160 is operated under the inverter control so as to correspond to various kinds of conditions. An inverter control device 161 responsible for the inverter control and the compressor 159 are mounted on an appropriate fixing member in the vicinity thereof. As shown in FIG. 3, when the compressor 159 is fixed on the engine 162, the inverter control device 161 is fixed and supported on another fixing member 163 to avoid the high temperature engine 162.

However, even though the working voltage increases from 12 volts to 42 volts, it is still a low voltage compared with a working voltage of about 100 volts to 200 volts which is used for an air conditioning intended for home use. Consequently, if it tends to obtain the same output as that of about 100 volts to 200 volts, there is a need to feed a large current. For addressing such a requirement, a plurality of wirings for supplying the electric power between the inverter control device 161 and a terminal 164 provided on the container 158, a plurality of wirings for supplying the electric power between the terminal 164 and the electric motor 160, and an electrode are increased in size, thereby increasing the weight of the compressor. Furthermore, the generation of noise may be increased to influence on the peripheral electronic devices. In each of the cases, it will be a problem for mounting on the vehicle. What is worse, the increase in size leads to the increase in cost.

SUMMARY OF THE INVENTION

An object of the present invention is to provide a compressor with a built-in electric motor suitable for a mobile structure without causing the increase in weight, cost, and noise by shortening the wiring distance from the inverter device to the electric motor. Another object of the invention is to provide a mobile structure having such a compressor with a built-in electric motor.

To achieve the above objects, a first aspect of the present invention is to provide a compressor with a built-in electric motor, including: a compression mechanism; the built-in electric motor for driving the compression mechanism; and a container for housing the compression mechanism and the built-in electric motor, wherein an inverter control device that performs an inverter control on the built-in electric motor is integrally provided on a part of the container and is connected to the electric motor.

According to such a configuration, since the inverter control device is provided on a part of the container, there is no need to provide comparatively long external wirings for connecting between the inverter control device and the container when the built-in electric motor housed in the container together with the compression mechanism is subjected to an inverter control by the inverter control device to operate the compression mechanism under various conditions. In addition, a single terminal can be shared between the connections for the inverter control device and the electric motor, so that one of the terminals conventionally used is removed. Accordingly, when it is mounted on the vehicle and used at a low voltage of 12 volts or 42 volts where the number of wirings and the size of electrode are increased, the wiring distance is shortened due to the elimination of external wirings, and the decrease in weight of the compressor is achieved because of reducing one of the terminals. Furthermore, the space for mounting the compressor including the inverter control device is reduced, so that the compressor is more easily mounted on the vehicle. Besides, there is an advantage in driving load and also in cost reduction.

A second aspect of the invention is to provide a compressor with a built-in electric motor, wherein an inverter control device that performs an inverter control on the built-in electric motor is integrally provided on a body of the container in which the compression mechanism and the electric motor are housed such that they are axially arranged in a line, and the inverter control device is connected to the electric motor.

According to such a configuration, the electric connection part of the inverter control device and the electric connection part of the electric motor housed in the body portion of the container become closer to each other. Thus, the length of the wiring in the container id reduced, and the weight and cost of the compressor depending on the wiring is reduced. Furthermore, the compressor of the present embodiment is easily installed in a restricted space of the vehicle since there is no need to increase the axial dimension of the container.

While novel features of the invention are set forth in the preceding, the invention, both as to organization and content, can be further understood and appreciated, along with other objects and features thereof, from the following detailed description and examples when taken in conjunction with the attached drawings.

DETAILED DESCRIPTION OF THE PREFERRED EMBODIMENTS

Hereinafter, a compressor with a built-in electric motor as one of preferred embodiments of the present invention and a mobile structure having such a compressor will be described with reference to the accompanying drawings for facilitating the understanding of the invention.

In this embodiment, the compressor is a scroll type compressor with a built-in electric motor to be mounted on an engine of a hybrid vehicle. However, the invention is not limited to such a type of compressor. The present invention is also applicable to any compressor for air-conditioning of the interior of a room in addition to the vehicle compartment of a typical mobile structure such as a motor vehicle, exerting the advantages of weight reduction and miniaturization. According to the invention, various kinds of compression mechanisms, for example rotary and reciprocation type compression mechanisms, may be used. Furthermore, any vertical type compressor may be used.

Figure 1:
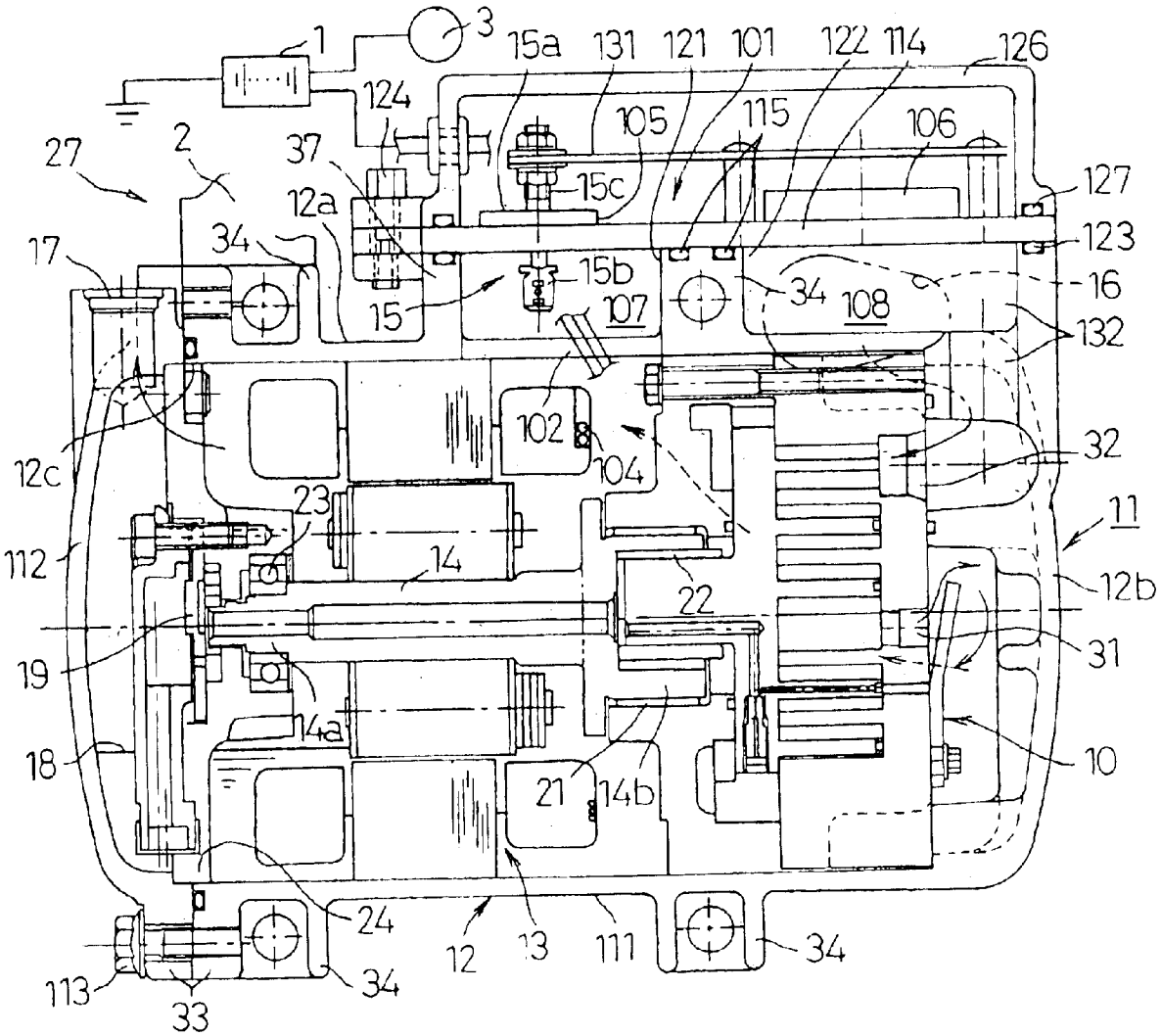
FIG. 1 is a cross sectional view of a compressor having a built-in electric motor in a state of being mounted on an engine according to one embodiment of the present invention.

As shown in FIG. 1, a hybrid vehicle 27 includes a gasoline-powered engine 2 and a motor 3 to be driven by the supply of power from a battery 1. The battery 1 is a rechargeable battery. While the vehicle runs using the engine 2, the battery 1 is charged. While the battery 1 has a sufficient charged capacity, the motor 3 is controlled to receive the supply of power for driving the vehicle with the motor 3 to restrict the discharge of exhaust gas to a minimum. When the vehicle is running with the engine 2, the engine 2 is controlled such that the engine 2 is stopped while the vehicle is temporally stopped, for example at a traffic light.

In this embodiment, as shown in FIG. 1, a compressor 11 driven by a built-in electric motor 13 is used for an air-conditioning of the vehicle compartment of the hybrid vehicle. The compressor 11 is constructed to receive the supply of power from the battery 1 to keep the air-conditioning of the vehicle compartment even though the vehicle running with the engine 2 is temporally stopped at a traffic light or the like and the engine 2 is stopped.

As shown in FIG. 1, a scroll type compression mechanism 10 and the electric motor 13 having a driving shaft 14 to drive the compression mechanism 10 are housed in a container 12, to constitute the compressor 11. Under the control of an inverter control device 101, the electric motor 13 is operated by the supply of power through a terminal 15 provided as inner and exterior electric connection parts of the container 12 to actuate the compressor 10. The compressor 10 inspires a refrigerant after passing through a refrigeration cycle via a suction port 16 of the container 12 to compress the refrigerant. Then, the compressed refrigerant is discharged into the inside of the container 12 to cool the electric motor 13, followed by discharging the refrigerant to an external pipe via a discharge port 17 of the container 12 to supply the refrigerant to the refrigeration cycle. Subsequently, these steps are repeated. The terminal 15 includes a body part 15*a,* an inner terminal 15*b,* and an external terminal 15*c*. In addition, the terminal 15 has a sealing structure. That is, the inner and external terminals 15*b,* 15*c* are connected to each other and pass through the body part 15*a,* where the passing-through portion of the body part 15*a* is sealed with a sealant such as a glass sealant.

In the container 12, there is oil 18 being stored. The oil is inhaled by a pump 19 driven by the driving shaft 14. The oil is then supplied to a main bearing 21 of a main axial part 14*b* of the driving shaft 14 on the side of the compression mechanism 10, a bearing 22 of a coupling portion between the main axial part 14*b* and the compression mechanism 10, and a sliding portion of the compression mechanism 10 to make smooth. After lubricating the bearings and the sliding portion, the oil 18 seeps through each lubricating object by means of a supply pressure and then returns to the inside of the container 12, followed by repeating such a lubricating process. By means of the action of a compatibility, a part of the refrigerant to be discharged into the container 12 brings the oil 18 stored in an oil storage portion 24 in the container 12 into a part such as a sub-bearing 23 which cannot be supplied with oil 18 by the pump 19, lubricating the sub-bearing 23 or the like. The sub-bearing 23 is responsible for bearing a sub-axial part 14*a* on the side of the driving shaft 14 opposite to the compression mechanism 10. Consequently, the compressor 11 having the built-in electric motor of the present embodiment satisfies the requirements for maintenance free.

Figure 2:
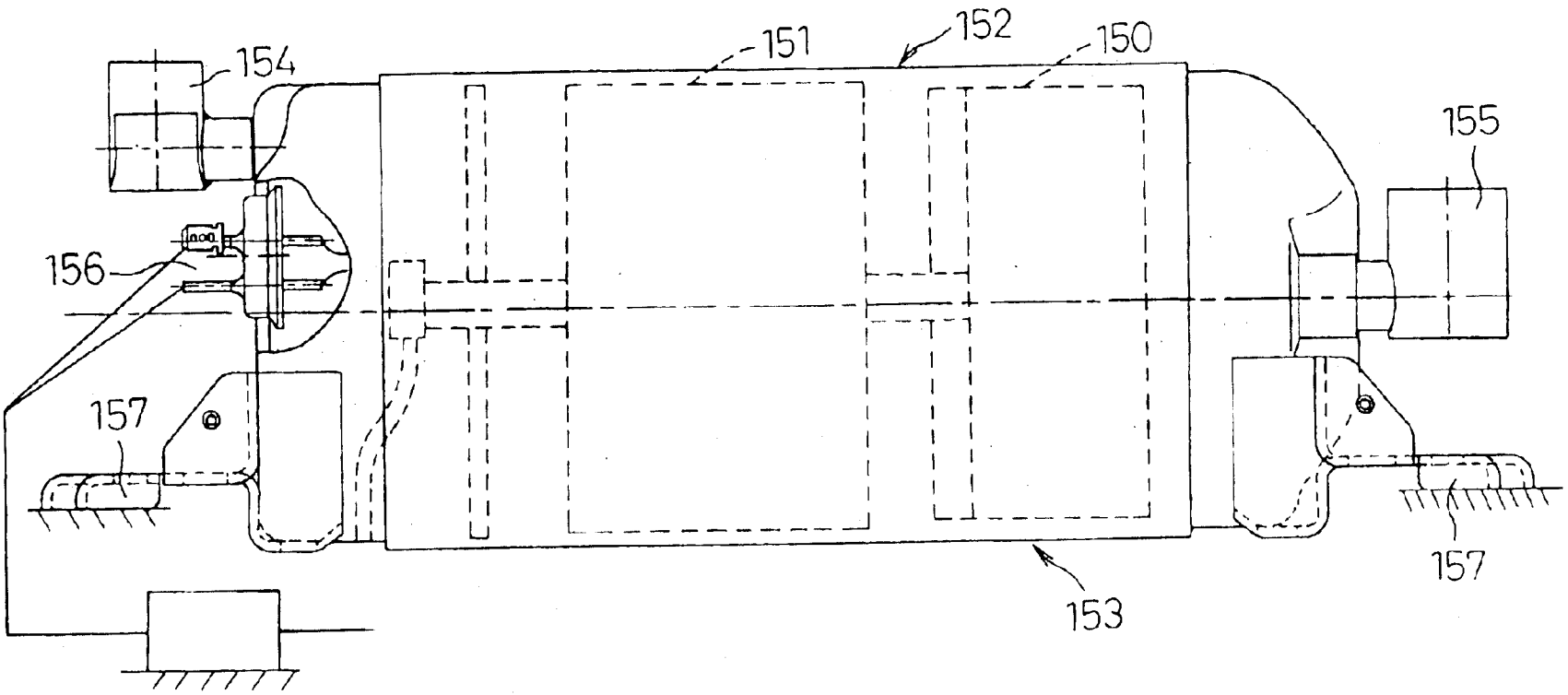
Fig. 2 Prior Art
FIG. 2 is a side view of a conventional compressor having a built-in electric motor in a container made of iron.
Figure 3:
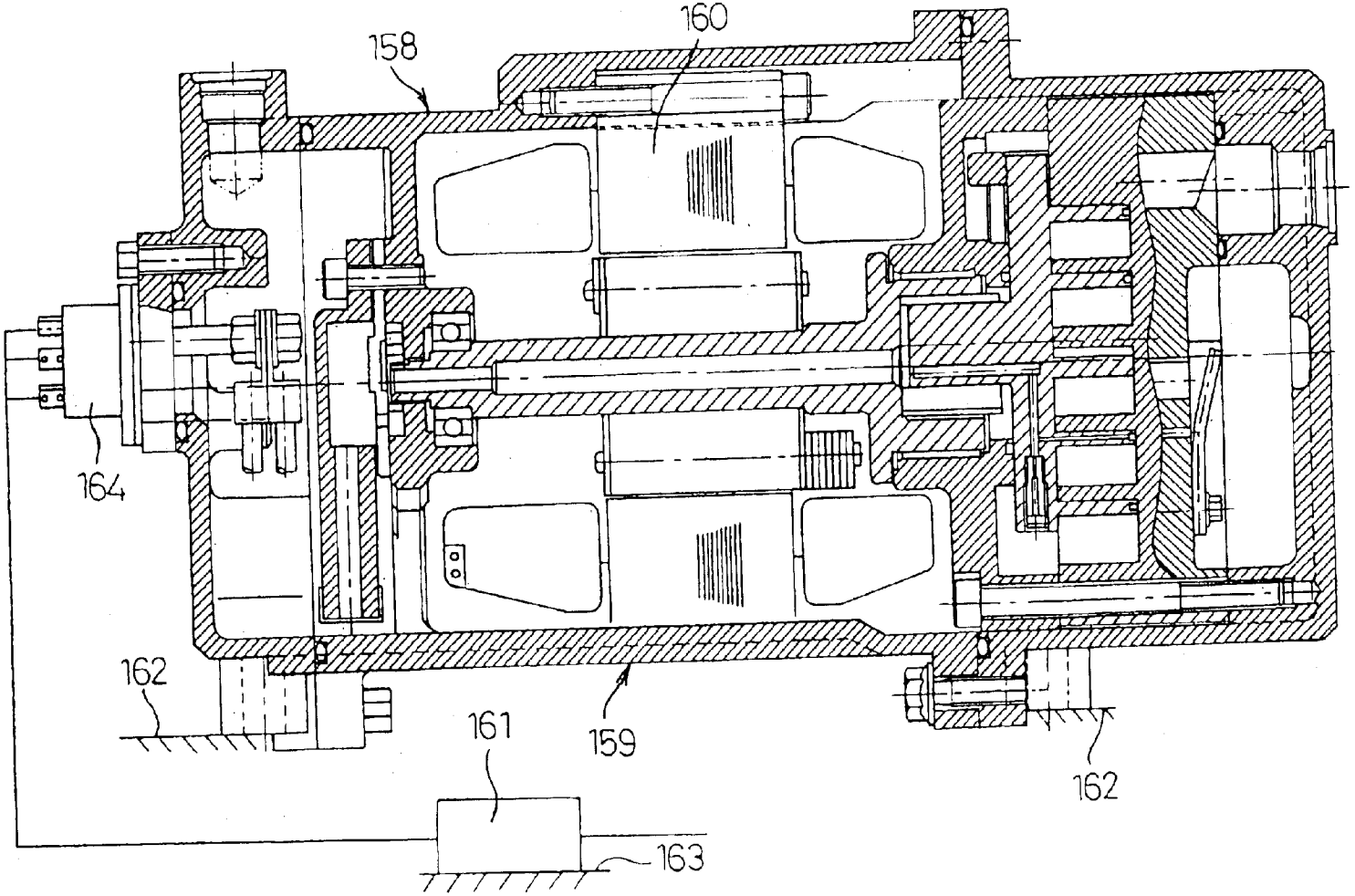
Fig. 3 Prior Art
FIG. 3 is a cross sectional view of a conventional compressor having a built-in electric motor in a container made of aluminum.

In the present embodiment, as shown in FIG. 1, an electrical connection between the inverter control device 101 and the container 12 is simplified. In this embodiment, that is, the inverter control device 101 is integrally mounted on a part of the container 12. The inverter control device 101 is electrically connected by an internal wiring 102 to the electric motor 13 by making a connection between the terminal 15 and a connection terminal 104 on the end of a coil 13*b* provided as a part of a stator 13*a* of the electric motor 13. The electric motor 13, which is housed in the container 12 together with the compression mechanism 10, is operated by being subjected to an inverter control by means of the inverter control device 101, allowing the compression mechanism 10 to work under the various kinds of conditions. In brief, a plurality of comparatively long external wirings, as shown in FIGS. 2 and 3, which connect between the inverter control device 101 and the container 12, are not required since the inverter control device 101 is mounted on a part of the container 12. In the conventional compressor, by the way, each of the inverter control unit and the electric motor requires its own terminal. In this embodiment, however, the terminal 15 can be shared for connecting between the inverter control unit 101 and the electric motor 13. The present embodiment is able to delete one of the terminals 15, which are conventionally required for both the electric motor and the inverter control device. That is, even though the dimensions of the wiring parts and the electrodes are increased as the compressor is installed in the vehicle 27 and is then used at a low voltage of 12 volts or 42 volts, the wiring distance is significantly shortened as much as a unnecessary part of the external wiring and one of the terminals are removed. Thus, the weight of the compressor is smaller than that of the conventional one. In addition, an installation space including the space for installing the inverter control device 101 is reduced, so that the compressor is easily mounted on the vehicle 27. There is also an advantage in driving load and also in cost reduction.

The inverter control device 101 is integrally mounted on a body portion 12*a* of the container 12 in which the compression mechanism 10 and the electric motor 13 are arranged in a line in the axial direction. Thus, comparing with the conventional one, the distance between an electric connection part of the inverter control device 101 and an electric connection part of the electric motor 13 housed in the body portion 12*a* of the container 12 (i.e., in the embodiment shown in the figure, the distance between the terminal 15 and the connection terminal 104) is shortened because of the integration of the inverter control device 101 with the body portion 12*a*. Thus, the length of wiring by the internal wiring 102 in the container 12 is also shortened, and the weight and cost of the compressor depending on the wiring is reduced. Furthermore, the compressor of the present embodiment is easily installed in a restricted space of the vehicle 27 or the like since there is no increase in the axial dimension of the container 12 even though the inverter control device 101 is provided thereon.

As shown in FIG. 1, the inverter control device 101 includes an electrode part 105 and an inverter part 106 which are electrically connected to each other. The inverter part 106, for example, is constructed of an inverter chip provided as a multi-layered circuit. In this case, however, a concrete configuration of such a circuit is no object in particular. The electrode part 105 is opposed to a high pressure portion 107 of the container 12, while the inverter part 106 is opposed to a low pressure portion 108 of the container 12. That is, the electrode part 105 and the inverter part 106 are separately placed in compartments (i.e., the high pressure portion 107 and the low pressure portion 108) which are formed in the container 12 so as to prevent them from extending from the container and being bulky. Simultaneously, the heated inverter part 106 is cooled down by means of a temperature difference between the inverter part 106 and a low-temperature refrigerant located in the low pressure portion 108. In this case, furthermore, the inverter part 106 is located on a position different from that of the electrode part 105 to be heated by a high-temperature refrigerant in the high pressure portion 107. Thus, the inverter part 106 is not or hardly influenced by heat, and the inverter control function is stably achieved for a long time as the temperature of a heating portion such as an inverter chip in the inverter control part is guaranteed. Furthermore, since the electrode part 105 opposite to the high pressure portion 107 is cooled, it becomes easily to make a connection with the electric motor 13 being positioned thereon for cooling.

Here, the high pressure portion 107 is located on the discharge passage side, where the high pressure portion 107 communicates with a discharge port 31 of the compression mechanism 10. On the other hand, the low pressure portion 108 is located on the intake passage side, where the low pressure portion 108 communicates with a suction port 32. The compression mechanism 10 sucks the refrigerant from the outside through the suction port 16 of the container 12 and then introduce into the compression mechanism 10 through the inside of the container 12 to compress the sucked refrigerant. After that, the refrigerant is discharged once into the container 12 to cool the electric motor 13, followed by being discharged to the outside of the container 12 through the discharge port 17. In this embodiment, the low pressure portion 108 and the high pressure portion 107, which are naturally occurred in the container 12, can be used as they are in the above movement of the refrigerant. No special passage design is required. The electrode part 105 and the electric motor 13 are opposite to each other with respect to the high pressure portion 107 and they are easily connected to each other through a short internal wiring 102. In particular, the low pressure portion 108 is just above the suction port 16 and they are connected to each other through a passage 132.

In this embodiment, the container 12 is constructed of two structural components, a housing main body 111 and an end wall 112 to be placed on an opening of the housing main body 111. That is, the housing main body 111 is provided as a single structural component on which the high pressure portion 107 and the low pressure portion 108 are separately formed. In addition, the housing main body 111 is integrally constructed of an end wall 12*b* of the container 12 and the body portion 12*a*. As the opposite end of the container 12 is provided as an opening 12*c*, another end wall 112 is placed on the opening 12*c* and is then fixed with a bolt 113 to construct the container 12. In such a construction of the container 12, the pressure difference between the high pressure portion 107 and the low pressure portion 108 is stably received by the housing main body 111 made of the single structural component of the container 12. When the high pressure portion 107 and the low pressure portion 108 are defined in the container 12 and the inverter control device 101 extends over these portions 107, 108, the inverter control device 101 is kept stably even though there is no specific countermeasure for a differential pressure to be required for the connection between the high pressure portion 107 and the low pressure portion 108. Furthermore, the container 12 of the present embodiment is constructed of two structural components, the number of thick flange portions 33 or bolts 113 for connecting these components are reduced, compared with that of the conventional one constructing of three structural components having two joining points. Thus, such a configuration of the present embodiment also allows the reduction in weight of the compressor, so that it is appropriate to be mounted on the vehicle 27 or the like.

Furthermore, the electric portion 105 and the inverter portion 106 of the inverter control device 101 are formed on an identical substrate 114. Thus, even though the inverter control device 101 has the electrode portion 105 and the inverter portion 106 which are separately formed thereon, the inverter control device 101 is simply installed in the container 12 using the single substrate 114 so as to be arranged opposite to the high pressure portion 107 and the low pressure portion 108. A portion of the container 12 facing to the high pressure side of the electrode portion 105 and another portion of the container 12 facing to the low pressure side of the inverter portion 106 are separated from each other through seal members 115. The configuration of the compressor of the present embodiment satisfies the requirements for providing the structure with no excess space because the compressor is constructed such that the electrode portion 105 and the inverter portion 106 are adjacent to each other, while the high pressure portion 107 and the low pressure portion 108 are adjacent to each other and are opposite to the respective portions 105, 106. Thereby, the high pressure condition and the low pressure condition for exerting a predetermined function cannot be impaired by leakage of the refrigerant even though the high pressure portion 107 and the low pressure portion 108 come very close to each other. One of leg portions 34 integrally formed on the container 12 is also provided as a partition between the high pressure portion 107 and the low pressure portion 108. Such a structure prevents the significant increase in weight to be caused by providing an additional wall for the partition.

As shown in FIG. 1, the high pressure portion 107 and the low pressure portion 108 are arranged in a line in the axial direction. In addition, these portions 107, 108 have their openings 121, 122, respectively. As shown in the figure, the inverter control device 101 is placed and fixed on a tubular wall 37 which is slightly extended outward from the periphery of the body portion 12*a* in which the above openings 121, 122 are formed. The inverter control device 101 is thus easily mounted on the container 12 from the outside to allow both electrode and inverter parts 105, 106 to face to the high and low pressure portions 107, 108, respectively. Here, the electrode portion 105 is formed such that it is provided as the body part 15*a* of the terminal 15. However, it is not limited to such a structure; it is also possible to prepare the body part 15*a* and the electrode portion 105 as separate components and to join them together.

In the embodiment shown in the figure, the inverter control device 101 is fixed on the opening end of the tubular wall 37. More specifically, the substrate 114 is placed on the tubular wall 37 through a seal member 123. The substrate 114 and the tubular wall 37 are joined with a bolt 124. The seal member 123 is provided as a pressure-tight sealing structure for ensuring the pressure condition in the container 12. Here, the electrode part 105 and the inverter part 106 are provided on the side of the tubular wall 37 opposite to the container 12. In other words, these parts 105, 106 are in an atmospheric pressure region. Thus, the predetermined high pressure portion 107 and the low pressure portion 108 are only ensured in the container 12 such that these portions 107, 108 are only located between the atmospheric pressure region and the container 12. On the other hand, the opposite side of the container 12 is opened to the air by means of pressure, so that a simplified mounting structure is obtained without any specific sealing structure that takes pressure in account.

Accordingly, the inverter control device 101 is protected from the influence of dust or water by being covered with a cover 126, as shown in FIG. 1, even though the inverter control device 101 is in the atmospheric pressure region and is opened with respect to pressure. In such a sense, it is preferable to adapt a sealing structure for waterproof and dust control by means of a sealing member 127. In the embodiment shown in the figure, the cover 126 and the substrate 114 are joined with the bolt 124. In this case, there is no need to provide the sealing member 127 with a pressure-resisting function. In addition, the cover 126 may be made of resin or rubber. Alternatively, the cover may be of having a mounting structure such as a hook or each of various kinds of engaging parts and fitting parts, which is elastically engaged or fitted with a part of the tubular wall 37 or the substrate 114 to provide a temporal fixed condition.

As shown in FIG. 1, the electrode part 105 and the inverter part 106 are connected to each other through a bus-bar 131. The structure for connecting these parts 105, 106 is simplified, allowing the reduction in cost and the increase in durability to withstand vibrations or the like.

By the way, the container 12 is made of an aluminum material, allowing the reduction in weight. Thus, it is appropriately mounted on the vehicle 27 or the like. In addition, there is an advantage in which various shapes of the container 12 can be easily obtained by means of a mass production using a die forming.

From the above description, the compressor 11 having the built-in electric motor 13 in each of the cases described above is appropriately applied for a mobile structure to be used together with the battery 1 to be moved. In addition, it is also appropriately applied for constructing a mobile structure such as a vehicle 27 on which the compressor 11 having the built-in electric motor 13 is mounted together with the battery 1.

The vehicle 27 may not be limited to a specific one such as a gasoline-powered vehicle, a hybrid vehicle, or an electric-powered vehicle. The present invention can be applied on various kinds of the mobile structures including special-purpose vehicles and working-purpose vehicles. In addition, the invention can be applied in air-conditioning systems for domestic use or the like for noise reduction.

According to the present invention, there is no need to provide comparatively long external wirings for connecting between the inverter control device and the container, which has been used in the conventional compressor. In addition, a single terminal is shared between the connections for the inverter control device and the electric motor, so that one of the terminals conventionally used is removed. Thus, the wiring distance is extremely shortened and the decrease in weight of the compressor is achieved. Furthermore, the space for mounting the compressor including the inverter control device is reduced, so that the compressor is more easily mounted on the vehicle or the like. Besides, there is also an advantage in driving load.

According to the invention, furthermore, comparing with the conventional one, the electric connection part of the inverter control device and the electric connection part of the electric motor housed in the body portion of the container become more close to each other. Thus, the length of the wiring in the container is reduced, and the weight and cost of the compressor depending on the wiring is reduced. Furthermore, the compressor of the invention is easily installed in a restricted space of the vehicle or the like since there is no need to increase the axial dimension of the container including the inverter control device.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A compressor with a built-in electric motor, comprising:

a compression mechanism;

a built-in electric motor that drives the compression mechanism;

a container that houses the compression mechanism and the built-in electric motor; and an inverter control device that performs an inverter control on the built-in electric motor, the device being integrally provided on a part of the container and connected to the electric motor;

wherein the inverter control device comprises an electrode part and an inverter part which are electrically connected to each other, the electrode part is opposite to a high pressure portion of the container, and the inverter part is opposite to a low pressure portion of the container.

2. The compressor with a built-in electric motor according to claim 1, wherein the high pressure portion of the container is provided on a discharge passage side from the compression mechanism, and the low pressure portion of the container is provided on a suction passage side.

3. The compressor with a built-in electric motor according to claim 1, wherein the high pressure portion and the low pressure portion of the container are formed on their respective portions made of the same member.

4. The compressor with a built-in electric motor according to claim 1, wherein the electrode part and the inverter part are provided on an identical substrate.

5. The compressor with a built-in electric motor according to claim 1, wherein a portion of the electrode part which faces the high pressure portion of the container, and a portion of the inverter part which faces the low pressure portion of the container, are partitioned from each other through a sealing member.

6. The compressor with a built-in electric motor according to claim 1, wherein the inverter control device is placed from the outside on a container wall in which the high pressure portion and the low pressure portion are opened side by side and is then fixed thereon.

7. The compressor with a built-in electric motor according to claim 1, wherein the partitioning is performed by sharing a leg portion integrally formed on the container.

8. The compressor with a built-in electric motor according to claim 1, wherein the electrode part and the inverter part are in an atmospheric pressure region.

9. The compressor with a built-in electric motor according to claim 8, wherein the electrode part and the inverter part are connected using a bus-bar.

10. A compressor with a built-in electric motor, comprising:

a compression mechanism;

a built-in electric motor that drives the compression mechanism;

a container that houses the compression mechanism and the built-in electric motor; and an inverter control device that performs an inverter control on the built-in electric motor, the device being integrally provided on a part of the container and connected to the electric motor;

wherein the inverter control device comprises an electrode part and an inverter part which are electrically connected to each other, and the electrode part and the inverter part are placed in first and second separate compartments, respectively, the first compartment having a pressure different from the second compartment.

11. The compressor with a built-in electric motor according to claim 10, wherein the inverter control device is in an atmospheric pressure region and is covered with a cover.

12. The compressor with a built-in electric motor according to claim 10, wherein the container is made of an aluminum-based material.

13. The compressor with a built-in electric motor according to claim 10, wherein the compressor is used with a battery that moves by a device to move said battery.

14. A mobile structure mounted with the compressor with a built-in electric motor according to claim 10, along with a battery.

15. A compressor with a built-in electric motor, comprising:

a compression mechanism;

a built-in electric motor that drives the compression mechanism;

a container that houses the compression mechanism and the built-in electric motor; and an inverter control device that performs an inverter control on the built-in electric motor, the device being integrally provided on a body portion of the container in which the compression mechanism and the built-in electric motor are housed such that they are axially arranged in a line and connected to the electric motor;

wherein the inverter control device comprises an electrode part and an inverter part which are electrically connected to each other, and the electrode part and the inverter part are placed in first and second separate compartments, respectively, the first compartment having a pressure different from the second compartment.

16. The compressor with a built-in electric motor according to claim 15, wherein the inverter control device is in an atmospheric pressure region and is covered with a cover.

17. The compressor with a built-in electric motor according to claim 15, wherein the container is made of an aluminum-based material.

18. The compressor with a built-in electric motor according to claim 15, wherein the compressor is used with a battery that moves by a device to move said battery.

19. A mobile structure mounted with the compressor with a built-in electric motor according to claim 15, along with a battery.

20. A compressor with a built-in electric motor comprising:

a compression mechanism;

a built-in electric motor that drives the compression mechanism;

a container that houses the compression mechanism and the built-in electric motor; and an inverter control device that performs an inverter control on the built-in electric motor, the device being integrally provided on a body portion of the container in which the compression mechanism and the built-in electric motor are housed such that they are axially arranged in a line and connected to the electric motor;

wherein the inverter control device comprises an electrode part and an inverter part which are electrically connected to each other, the electrode part is opposite to a high pressure portion of the container, and the inverter part is opposite to a low pressure portion of the container.

* * * * *